US010724748B2

(12) United States Patent
Taniguchi et al.

(10) Patent No.: US 10,724,748 B2
(45) Date of Patent: Jul. 28, 2020

(54) AIR-CONDITIONING APPARATUS

(71) Applicant: Mitsubishi Electric Corporation, Tokyo (JP)

(72) Inventors: Yoshihiro Taniguchi, Tokyo (JP); Shigeo Takata, Tokyo (JP); Shinsaku Kusube, Tokyo (JP); Daisuke Abe, Tokyo (JP); Tomoki Kobayashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 10 days.

(21) Appl. No.: 16/301,457

(22) PCT Filed: Jul. 22, 2016

(86) PCT No.: PCT/JP2016/071492
§ 371 (c)(1),
(2) Date: Nov. 14, 2018

(87) PCT Pub. No.: WO2018/016064
PCT Pub. Date: Jan. 25, 2018

(65) Prior Publication Data

US 2019/0301753 A1 Oct. 3, 2019

(51) Int. Cl.
*F24F 1/24* (2011.01)
*F24F 1/22* (2011.01)
*F24F 1/26* (2011.01)

(52) U.S. Cl.
CPC ..... *F24F 1/24* (2013.01); *F24F 1/22* (2013.01); *F24F 1/26* (2013.01)

(58) Field of Classification Search
CPC ..... F24F 1/24; F24F 1/22; F24F 1/26; H05K 7/20936; H05K 7/20309; H05K 1/0204
See application file for complete search history.

(56) References Cited

U.S. PATENT DOCUMENTS 4,720,981 A * 1/1988 Helt ..... F25B 40/00 165/80.4
2011/0079033 A1* 4/2011 Okuda ..... F24F 1/22 62/259.2

(Continued)

FOREIGN PATENT DOCUMENTS

EP 1 684 022 A1 7/2006
JP 2004-108677 A 4/2004

(Continued)

OTHER PUBLICATIONS

International Search Report of the International Searching Authority dated Oct. 18, 2016 for the corresponding international application No. PCT/JP2016/071492 (and English translation).

*Primary Examiner* — Frantz F Jules
*Assistant Examiner* — Lionel Nouketcha
(74) *Attorney, Agent, or Firm* — Posz Law Group, PLC

(57) ABSTRACT

An air-conditioning apparatus includes a refrigerant pipe through which refrigerant that flows through the refrigeration cycle passes; a pipe-side plate thermally connected to the refrigerant pipe; a control box thermally connected to the pipe-side plate and containing an electric component including a heating element; a housing of an outdoor unit, the housing containing the pipe-side plate and the control box; a positioning element fixing the pipe-side plate and the control box to each other; and a fastening element fixing the control box and the positioning element to each other. At least one side surface of the housing has a work opening. A front portion of the control box is positioned closer to the work opening in the housing, and a rear portion of the control box is positioned closer to a rear surface of the housing, the rear surface facing the side surface having the work opening.

8 Claims, 11 Drawing Sheets

(56) References Cited

U.S. PATENT DOCUMENTS

| | | | | |
|---|---|---|---|---|
| 2011/0126568 | A1* | 6/2011 | Okuda | F24F 1/24<br>62/259.2 |
| 2012/0279251 | A1* | 11/2012 | Kido | F24F 1/24<br>62/498 |
| 2013/0125578 | A1* | 5/2013 | Lee | F25B 13/00<br>62/498 |
| 2017/0115013 | A1* | 4/2017 | Kim | F24F 13/20 |

FOREIGN PATENT DOCUMENTS

| | | | |
|---|---|---|---|
| JP | 2009-299957 | A | 12/2009 |
| JP | 2010-114121 | A | 5/2010 |
| JP | 4471023 | B2 | 6/2010 |
| JP | 2010-169393 | A | 8/2010 |
| JP | 2015-031450 | A | 2/2015 |
| JP | 2015-127622 | A | 7/2015 |

* cited by examiner

AIR-CONDITIONING APPARATUS

CROSS REFERENCE TO RELATED APPLICATION

This application is a U.S. national stage application of PCT/JP2016/071492 filed on Jul. 22, 2016, the contents of which are incorporated herein by reference.

TECHNICAL FIELD

The present invention relates to an air-conditioning apparatus, and more particularly, to an attachment structure for attaching a cooler for cooling an electric component and a control box included in the air-conditioning apparatus.

BACKGROUND ART

Conventional air-conditioning apparatuses installed in, for example, buildings or commercial facilities, include air-conditioning apparatuses in which a heat exchanger is disposed on a side surface and a fan is disposed on a top surface (see, for example, Patent Literature 1). Patent Literature 1 describes an air-conditioning apparatus in which heat radiation fins are arranged to project into a path along which air used for heat exchange is caused to flow by a fan. The heat radiation fins are arranged in contact with heating elements, such as an electric component that generates heat and a control box that contains the electric component, at a low thermal resistance to cool the heating elements.

An example of cooling unit for cooling the heating elements uses refrigerant of a refrigeration cycle (see, for example, Patent Literature 2). Patent Literature 2 describes an air-conditioning apparatus including cooling unit that uses refrigerant. The cooling unit is arranged to face an opening in an outdoor unit casing and is positioned on the front side of a heating element as viewed from the opening.

CITATION LIST

Patent Literature

Patent Literature 1: Japanese Unexamined Patent Application Publication No, 2010-169393

Patent Literature 2: Japanese Patent No. 4471023

SUMMARY OF INVENTION

Technical Problem

Compared to the air cooling method using the heat radiation fins, the refrigerant cooling method employed in the air-conditioning apparatus imposes less limitations on the arrangement of the control box in the air-conditioning apparatus. In addition, the apparatus size can be reduced since installation of large heat radiation fins is not necessary. However, since a pipe is attached to the cooler used in the refrigerant cooling method, the control box needs to be separated from the cooler to replace the control box, and the thermal connection needs to be reestablished after the replacement.

In the air-conditioning apparatus according to Patent Literature 2, the cooler is disposed on the front side of the control box as viewed from the position of the operator who replaces the control box, and serves as an obstacle when the operator removes the control box. Therefore, when the control box is removed, for example, there is a risk that the control box will be brought into contact with the pipe attached to the cooler and cause leakage of the refrigerant. There is also a risk that a cooling surface of the cooler will be damaged and the flatness thereof will be reduced.

When the cooler is disposed on a side surface, a top surface, or a bottom surface of a housing of the air-conditioning apparatus, it is difficult to ensure sufficient work space for attaching or removing the control box to or from the cooler because a fixing element used to bring the cooler and the heating element into tight contact is attached in a direction perpendicular to the contact surfaces of the cooler and the heating element. Accordingly, the operator may be required to extend their arms in an unnatural posture to attach or remove the control box to or from the cooler. To avoid this problem, the cooler needs to be positioned behind the control box as viewed from the position of the operator who replaces the control box. However, in this case, the cooler is visually blocked by the control box, and therefore the control box cannot be easily attached to or removed from the cooler.

The present invention has been made to solve the above-described problem, and provides an air-conditioning apparatus that enables a control box to be easily attached to or removed from a cooler even when the cooler is positioned behind the control box as viewed from the position of the operator who replaces the control box.

Solution to Problem

An air-conditioning apparatus according to an embodiment of the present invention includes a refrigeration cycle in which a compressor, a heat-source-side heat exchanger, a refrigerant flow control device, and a load-side heat exchanger are connected. The air-conditioning apparatus includes a refrigerant pipe through which refrigerant that flows through the refrigeration cycle passes; a pipe-side plate thermally connected to the refrigerant pipe; a control box thermally connected to the pipe-side plate and containing an electric component including a heating element; a housing of an outdoor unit, the housing containing the pipe-side plate and the control box; a positioning element fixing the pipe-side plate and the control box to each other; and a fastening element fixing the control box and the positioning element to each other. At least one side surface of the housing has a work opening. A front portion of the control box is positioned closer to the work opening in the housing, and a rear portion of the control box is positioned closer to a rear surface of the housing, the rear surface facing the side surface having the work opening. The pipe-side plate is disposed between the control box and the positioning element at the rear portion of the control box. A bent portion of the positioning element that is fixed to the control box by the fastening element is positioned closer to the front portion of the control box.

Advantageous Effects of Invention

According to the present invention, the bent portion of the positioning element, which is fixed to the control box by the fastening element, is positioned closer to the front portion of the control box. Thus, even when a cooler is disposed behind the control box as viewed from the position of the operator who replaces the control box, the operator can easily access the position at which the positioning element is fixed to the control box, and the control box can be easily attached to or removed from the cooler.

DESCRIPTION OF EMBODIMENTS

Embodiment 1

Figure 1:
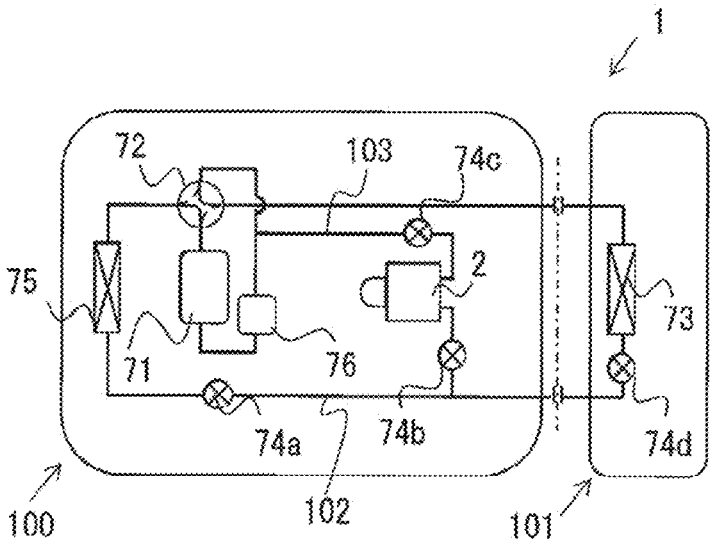
FIG. 1 is a system diagram of pipes of a refrigerant circuit of an air-conditioning apparatus according to Embodiment 1 of the present invention.

FIG. 1 is a system diagram of pipes of a refrigerant circuit of an air-conditioning apparatus according to Embodiment 1 of the present invention. As illustrated in FIG. 1, the air-conditioning apparatus 1 includes an indoor unit 101 installed indoors and an outdoor unit 100 installed outdoors. The indoor unit 101 and the outdoor unit 100 are connected to each other by refrigerant pipes.

The indoor unit 101 includes a refrigerant flow control device 74*d* and a load-side heat exchanger 73 disposed therein. The load-side heat exchanger 73 may be, for example, a cross-fin-type fin-and-tube heat exchanger. The load-side heat exchanger 73 functions as a condenser (radiator) to condense and liquefy refrigerant during a heating operation, and functions as an evaporator to evaporate and gasify the refrigerant during a cooling operation. The outdoor unit 100 includes a compressor 71, a heat-source-side heat exchanger 75, and a refrigerant flow control device 74*a* disposed therein. The outdoor unit 100 also includes a flow switching device 72 and an accumulator 76. The flow switching device 72 and the accumulator 76 are not essential, and may be omitted. The compressor 71, the heat-source-side heat exchanger 75, the refrigerant flow control device 74*a*, the refrigerant flow control device 74*d*, and the load-side heat exchanger 73 of the air-conditioning apparatus 1 are connected to each other by refrigerant pipes to form a refrigerant circuit 102 that constitutes a refrigeration cycle.

The air-conditioning apparatus 1 also includes a refrigerant circuit 103 that connects a portion between the refrigerant flow control device 74*a* and the refrigerant flow control device 74*d* to a portion between the flow switching device 72 and the accumulator 76. The refrigerant circuit 103 includes a refrigerant flow control device 74*b*, a pipe-side plate 2 that serves as a cooler, and a refrigerant flow control device 74*c*. Thus, the air-conditioning apparatus 1 includes a cooler that are connected in parallel to the heat-source-side heat exchanger 75 and the load-side heat exchanger 73.

The compressor 71 sucks in and compresses gas refrigerant and discharges high-temperature high-pressure gas refrigerant. The suction side of the compressor 71 is connected to the accumulator 76. The discharge side of the compressor 71 is connected, through the flow switching device 72, to the heat-source-side heat exchanger 75 in the cooling operation and to the load-side heat exchanger 73, which is mounted in the indoor unit 101, in the heating operation.

The flow switching device 72 is used to switch the refrigerant passage. In the cooling operation, the flow switching device 72 connects the discharge side of the compressor 71 to the heat-source-side heat exchanger 75 and connects the suction side of the compressor 71 to the load-side heat exchanger 73 of the indoor unit 101 through the accumulator 76. In the heating operation, the flow switching device 72 connects the discharge side of the compressor 71 to the load-side heat exchanger 73 of the indoor unit 101 and connects the suction side of the compressor 71 to the heat-source-side heat exchanger 75 through the accumulator 76.

The accumulator 76, which is connected to the suction side of the compressor 71, accumulates excessive refrigerant generated depending on the difference between the heating operation mode and the cooling operation mode, a transitional change in operation, or load conditions.

The refrigerant flow control device 74*a*, the refrigerant flow control device 74*b*, the refrigerant flow control device 74*c*, the refrigerant flow control device 74*d*, and a refrigerant flow control device 74*e* are, for example, electronic control valves that control the flow rate of the refrigerant that flows through the pipes in the refrigerant circuit 102, the refrigerant circuit 103, and a refrigerant circuit 104, and function as expansion valves that reduce the pressure of the refrigerant that flows therein by controlling the flow rate of the refrigerant.

Figure 2:
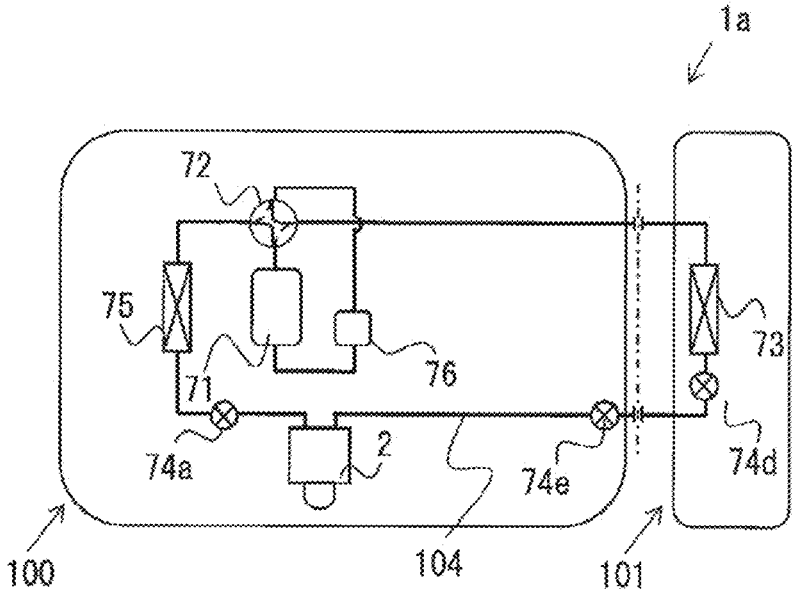
FIG. 2 is a modification of the system diagram of pipes of the refrigerant circuit of the air-conditioning apparatus according to Embodiment 1 of the present invention.

FIG. 2 is a modification of the system diagram of pipes of the refrigerant circuit of the air-conditioning apparatus according to Embodiment 1 of the present invention. Components having the same configurations as those in the air-conditioning apparatus 1 illustrated in FIG. 1 are denoted by the same reference symbols, and description thereof is omitted. An air-conditioning apparatus 1*a* has a refrigerant circuit 104 including a pipe-side plate 2 that serves as a cooler and a refrigerant flow control device 74*e* at positions between the refrigerant flow control device 74*a* and the refrigerant flow control device 74*d* in the refrigerant circuit 102 illustrated in FIG. 1. In other words, the air-conditioning apparatus 1*a* is configured such that the cooler is connected in series to the heat-source-side heat exchanger 75 and the load-side heat exchanger 73.

The outdoor unit 100 of the air-conditioning apparatus 1 according to Embodiment 1 of the present invention will now be described with reference to the drawings. The air-conditioning apparatus 1 and the air-conditioning apparatus 1*a* differ in that whether the cooler is connected in series or parallel to the heat exchangers, but include the same devices. Therefore, only the devices included in the air-conditioning apparatus 1 will be described below, and description of the devices included in the air-conditioning apparatus 1*a* will be omitted.

Figure 3:
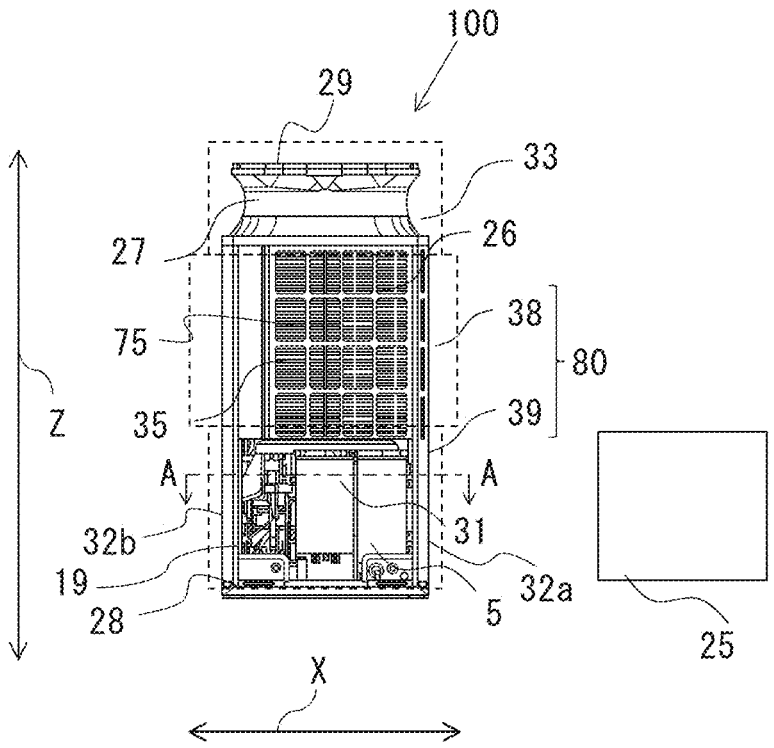
FIG. 3 is a front view of an outdoor unit included in the air-conditioning apparatus according to Embodiment 1 of the present invention.
Figure 4:
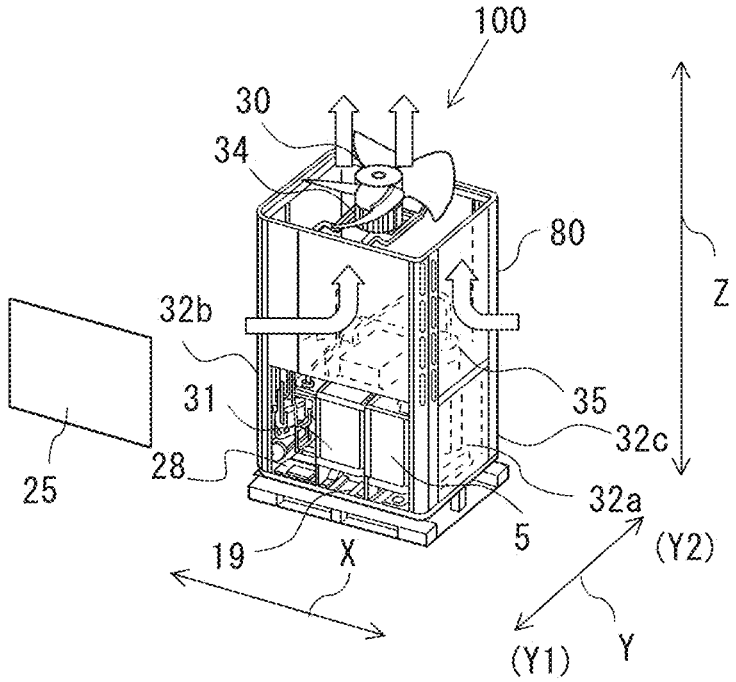
FIG. 4 is a perspective view of the outdoor unit included in the air-conditioning apparatus according to Embodiment 1 of the present invention.

FIG. 3 is a front view of the outdoor unit included in the air-conditioning apparatus according to Embodiment 1 of the present invention. FIG. 4 is a perspective view of the outdoor unit included in the air-conditioning apparatus according to Embodiment 1 of the present invention. In FIGS. 3 and 4, the X-axis indicates the width direction of the outdoor unit 100, the Y-axis indicates the depth direction of the outdoor unit 100, and the Z-axis indicates the height direction of the outdoor unit 100. In the depth direction, Y1-side is defined as front and Y2-side is defined as back.

The outdoor unit 100 is connected to the indoor unit 101 by the refrigerant pipes, and functions as a heat source device. As illustrated in FIG. 3, the outdoor unit 100 includes a fan unit 33 disposed at the top, a heat exchange unit 38 disposed below the fan unit 33, and a machine unit 39 disposed below the heat exchange unit 38 at the bottom of the outdoor unit 100. The heat exchange unit 38 and the machine unit 39 of the outdoor unit 100 form a substantially cuboidal housing 80. Although the housing 80 is substantially cuboidal in FIGS. 3 and 4, the shape thereof is not limited as long as the devices and structures such as the heat exchanger, the compressor, and a control box can be placed in the housing 80, and may be other shapes such as a cylindrical or prism shape.

As illustrated in FIG. 4, the fan unit 33 of the outdoor unit 100 includes a fan 30. The fan 30 is rotated by a fan motor 34 so that air is sucked into the outdoor unit 100 and then discharged. The fan unit 33 also includes a fan guard 27 that surrounds the fan 30. The fan guard 27 includes an air passage portion having an air outlet 29 at a discharge side thereof. In FIG. 4, the arrows represent the flow of air that is sucked into the heat exchange unit 38 and then discharged. First, the fan 30 is activated so that the inside of the outdoor unit 100 is set to a negative pressure. The air sucked into the heat exchange unit 38 through a side surface of the housing 80 is used for heat exchange in the heat-source-side heat exchanger 75. The air that has been sucked into the outdoor unit 100 through the heat-source-side heat exchanger 75 is discharged through the air outlet 29 formed at the top of the outer shell by the fan 30.

The heat exchange unit 38 of the outdoor unit 100 includes the heat-source-side heat exchanger 75, which exchanges heat between the refrigerant supplied thereto and the air that passes therethrough due to the negative pressure generated by the fan 30. The heat-source-side heat exchanger 75 functions as a condenser (radiator) to condense and liquefy the refrigerant during the cooling operation, and functions as an evaporator to evaporate and gasify the refrigerant during the heating operation. The heat-source-side heat exchanger 75 is mounted in the outdoor unit 100 by being fixed to four side surfaces, which are front, back, left, and right side surfaces (surfaces in the X and Y directions), of the housing 80. It is not necessary that the heat-source-side heat exchanger 75 be fixed to the four side surfaces of the housing 80, and may instead be fixed to any one of the side surfaces, or to any two or three of the side surfaces. The heat-source-side heat exchanger 75 may be arranged to stand upright or be inclined such that the top thereof is shifted outward and the bottom thereof is shifted inward in side view.

The heat-source-side heat exchanger 75 may be, for example, a cross-fin-type fin-and-tube heat exchanger. The heat-source-side heat exchanger 75 includes heat transfer tubes through which the refrigerant flows and heat exchanger fins 35 to which the heat transfer tubes are connected. The heat exchange unit 38 also includes a fin guard 26 that faces the heat exchanger fins 35. The fin guard 26 protects the heat exchanger fins 35 to prevent the heat exchanger fins 35 from being damaged by an unexpected external impact. In FIG. 3, outer shell panels that constitute the housing 80 of the heat exchange unit 38 are omitted to show the internal structure of the heat exchange unit 38. In FIG. 4, the internal structure of the heat exchange unit 38 is omitted to show the flow of air.

The housing 80 of the machine unit 39 includes a front panel 25 that constitutes a front portion of the outer shell, a right panel 32*a* and a left panel 32*b* that constitute left and right portions of the outer shell, a rear panel 32*c* that constitutes a rear portion of the outer shell, and a bottom panel 28 that defines a bottom surface of the machine unit 39. In FIGS. 3 and 4, the front panel 25 is removed to show the internal structure of the machine unit 39. In FIGS. 3 and 4, the outer shell of the machine unit 39 is formed such that the right panel 32*a* and the left panel 32*b* that constitute the left and right portions of the outer shell and the rear panel 32*c* that constitutes the rear portion of the outer shell are three separate panels. However, these panels may be integrated together. Alternatively, one or both of the right panel 32*a* and the left panel 32*b* may be formed so as to include a portion of a rear panel.

A work opening 19 that enables an operator to access the inside of the machine unit 39 is formed in a front portion of the housing 80 of the machine unit 39. The front panel 25, which is flat-plate-shaped, is removably attached to the front portion of the housing 80 of the machine unit 39, and constitutes the front portion of the outer shell of the housing 80 in the attached state. The work opening 19 is exposed when the front panel 25 is removed from the housing 80, and is covered when the front panel 25 is attached to the housing 80.

Figure 5:
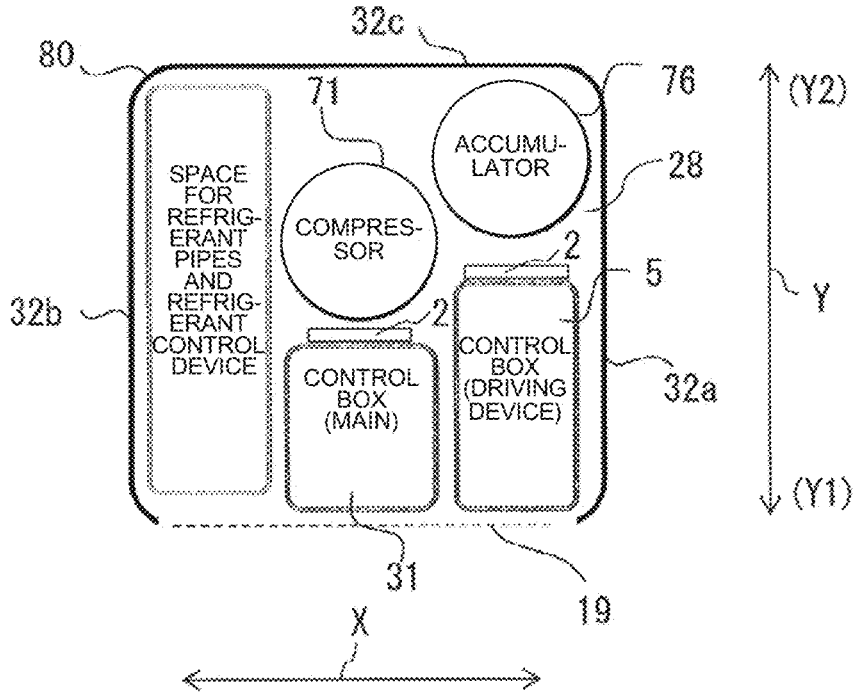
FIG. 5 is a sectional view of the outdoor unit included in the air-conditioning apparatus according to Embodiment 1 of the present invention taken along line A-A in FIG. 3.

FIG. 5 is a sectional view of the outdoor unit included in the air-conditioning apparatus according to Embodiment 1 of the present invention taken along line A-A in FIG. 3. Devices mounted on the bottom panel 28 will now be described with reference to FIG. 5. The housing 80 of the machine unit 39 contains the compressor 71 that compresses and discharges the refrigerant, the accumulator 76 capable of accumulating excessive refrigerant, a control box 31 that contains an electric component, and a control box 5, which are mounted on the bottom panel 28. The housing 80 also contains pipe-side plates 2 that are fixed to the control box 5 and the control box 31 and serve as coolers. Referring to FIG. 5, the space for the refrigerant pipes and a refrigerant control device may be used as a work space for attaching and removing a control box to and from a cooler.

The control box 5 and the control box 31 contain electric components including heating elements that control, for example, the flow of the refrigerant that circulates between the outdoor unit 100 and the indoor unit (not shown), the rotation speed of the fan 30, or the frequency of the compressor 71. The control box 5 and the control box 31 are arranged to face the work opening 19, and are exposed when the front panel 25 is removed. In the following description, it is assumed that the control box 5 is a control box with no work space on either of the left and right sides thereof in the width direction of the work opening 19 (X-axis direction), and that the control box 31 is a control box having a work space on one of the left and right sides thereof.

Figure 6:
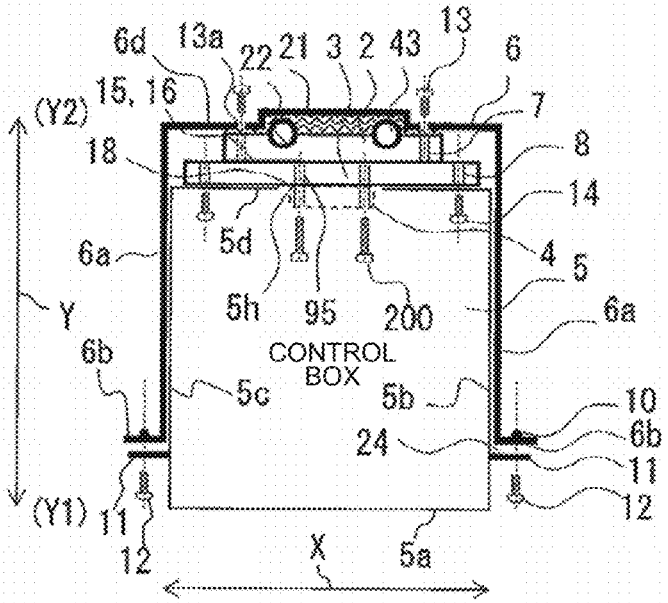
FIG. 6 is a simplified plan view of an attachment structure for attaching a cooler to a control box installed in the air-conditioning apparatus according to Embodiment 1 of the present invention.
Figure 7:
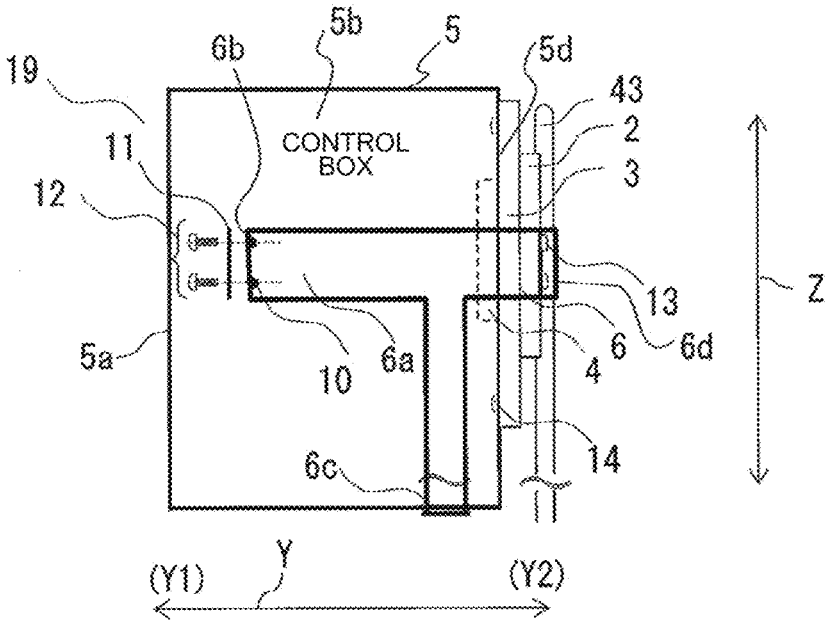
FIG. 7 is a simplified side view of the attachment structure for attaching the cooler to the control box installed in the air-conditioning apparatus according to Embodiment 1 of the present invention.

FIG. 6 is a simplified plan view of an attachment structure for attaching a cooler to a control box installed in the air-conditioning apparatus according to Embodiment 1 of the present invention. FIG. 7 is a simplified side view of the attachment structure for attaching the cooler to the control box installed in the air-conditioning apparatus according to Embodiment 1 of the present invention. In FIG. 6, the Y-axis indicates the depth direction of the outdoor unit 100. The bottom side (Y1) in FIG. 6 is the front side at which the work opening 19 is provided, and the top side (Y2) in FIG. 6 is the back side that corresponds to the rear side of the outdoor unit 100. The X-axis indicates the width direction of the housing 80 of the outdoor unit 100. In FIG. 7, the Y-axis indicates the depth direction of the outdoor unit 100. The left side (Y1) in FIG. 7 is the front side at which the work opening 19 is provided, and the right side (Y2) in FIG. 6 is the back side that corresponds to the rear side of the outdoor unit 100. The Z-axis indicates the height direction of the outdoor unit 100.

The control box 5 is cuboidal. A front portion 5*a* of the control box 5 is positioned closer to the work opening 19 in the housing 80, and a rear portion 5*d* of the control box 5 is positioned closer to the rear panel 32*c* of the housing 80. A right wall portion 5*b* of the control box 5 that connects the front portion 5*a* and the rear portion 5*d* is positioned closer to the right panel 32*a* of the housing 80, and a left wall portion 5*c* of the control box 5 that connects the front portion 5*a* and the rear portion 5*d* is positioned closer to the left panel 32*b* of the housing 80. The bottom surface of the control box 5 is placed on the bottom panel 28, and the top surface of the control box 5 is positioned closer to the top inside surface of the machine unit 39. Plate-shaped supports 11, which are fixed to bent portions 6*b* of a positioning element 6 by fastening elements 12, are provided on the right wall portion 5*b* and the left wall portion 5*c* of the control box 5 at positions closer to the front portion 5*a*. The supports 11 have the shape of a flat rectangular plate having a surface that faces the work opening 19. Although the supports 11 have the shape of a flat rectangular plate, the supports 11 may instead have the shape of, for example, a circular or polygonal plate as long as the supports 11 can be fixed to the bent portions 6*b*. Although the control box 5 is cuboidal in FIGS. 6 and 7, the shape thereof is not limited to this. The control box 5 may instead have, for example, a shape with various recesses or projections, a cylindrical, prism, or spherical shape, or a shape with truncated corners in accordance with the shape of the accommodation space. Although the control box 5 is oriented so that the side surfaces thereof face the respective side surfaces of the housing 80, the control box 5 may instead be installed in a horizontally or vertically rotated state so that the side surfaces thereof do not face the respective side surfaces of the housing 80.

The pipe-side plate 2, which serves as a cooler, is placed behind the rear portion 5*d* of the control box 5. A contact surface 15 of the pipe-side plate 2 faces a surface in contact with a refrigerant pipe 43 is in contact with a control box-side plate 3. The control box 5 and a heating element 4 are thermally connected to the pipe-side plate 2 through the control box-side plate 3. As illustrated in FIG. 6, the rear portion 5*d* (Y2-side portion) of the control box 5 has a control box opening 5*h* that enables the heating element 4 to be in contact with the control box-side plate 3. It is not essential that the control box opening 5*h* be formed, and the rear portion 5*d* of the control box 5 may be disposed between the heating element 4 and the control box-side plate 3. The heating element 4 is fixed to the control box-side plate 3 by fixing elements 200 installed from the inside of the control box 5.

Figure 8:
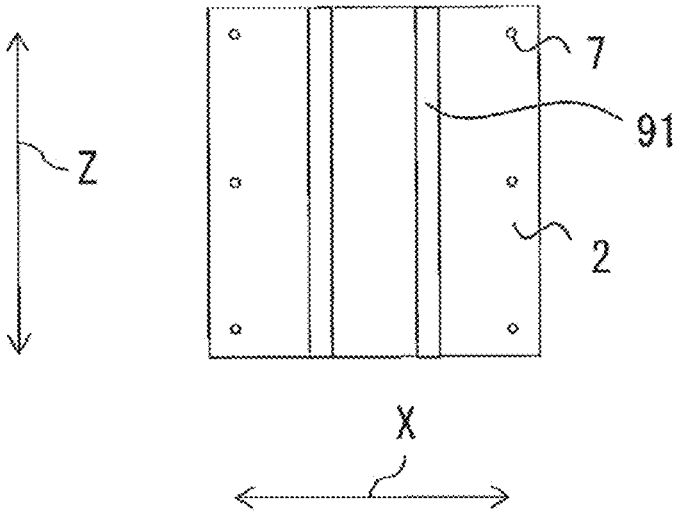
FIG. 8 is a rear view of a pipe-side plate fixed to a positioning element in the air-conditioning apparatus according to Embodiment 1 of the present invention.

FIG. 8 is a rear view of the pipe-side plate fixed to the positioning element in the air-conditioning apparatus according to Embodiment 1 of the present invention. The pipe-side plate 2 will now be described with reference to FIGS. 6, 7, and 8. The pipe-side plate 2 serves as a cooler that cools the control box 5 or the heating element 4, such as an electric component, mounted in the control box 5. The pipe-side plate 2 is disposed closer to the rear portion 5*d* of the control box 5 and between the positioning element 6 and the control box 5. The pipe-side plate 2 is, for example, a flat cuboidal plate made of a metal, such as aluminum or copper. As illustrated in FIG. 8, the surface of the pipe-side plate 2 that is in contact with the refrigerant pipe 43 has pipe grooves 91 having a shape that matches the shape of the refrigerant pipe 43. The pipe-side plate 2 partially covers the refrigerant pipe 43 in the refrigerant circuit 103 or the refrigerant circuit 104, and is in contact with and thermally connected to the refrigerant pipe 43. A heat insulating element 21 may be provided between the positioning element 6 and the pipe-side plate 2 so that the refrigerant pipe 43 is disposed between and in contact with the heat insulating element 21 and the pipe-side plate 2. The heat insulating element 21 is provided to prevent a reduction in the heat exchange efficiency of the pipe-side plate 2 due to, for example, leakage of cooling energy of the refrigerant pipe 43 through the positioning element 6.

As illustrated in FIG. 8, the pipe-side plate 2 has fixing-element holes 7 used to fix the pipe-side plate 2 to the positioning element 6. Preferably, the fixing-element holes 7 are not to be formed as through holes to prevent entrance of moisture. However, to reduce the processing cost, the fixing-element holes 7 may be formed as through holes. In such a case, when, for example, fixing elements 13 such as screws illustrated in FIGS. 6 and 7 are used, the fixing elements 13 preferably have a sealing function. Alternatively, a sealing material may be applied. When there is no risk of corrosion due to moisture, it is not necessary to use the sealing material or the like.

The manner in which the refrigerant pipe 43 and the pipe-side plate 2 are connected together will now be described with reference to FIG. 6. A thermal-resistance-reducing element 22 is disposed between the refrigerant pipe 43 and the pipe-side plate 2 to reduce the thermal resistance and the influence of small projections and recesses. The thermal-resistance-reducing element 22 may be, for example, thermal grease or a heat dissipation sheet. The thermal-resistance-reducing element 22 is capable of reducing the thermal resistance by reducing the number of small holes between the refrigerant pipe 43 and the pipe-side plate 2. The thermal-resistance-reducing element 22 is also capable of preventing entrance of moisture or air containing moisture into the gap between the refrigerant pipe 43 and the pipe-side plate 2. When the refrigerant pipe 43 is made of copper and the pipe-side plate 2 is made of aluminum, galvanic corrosion between copper and aluminum may occur if moisture enters the gap between the refrigerant pipe 43 and the pipe-side plate 2. The thermal-resistance-reducing element 22 reduces the occurrence of galvanic corrosion. There may be a case that the occurrence of galvanic corrosion is not sufficiently reduced simply by using the thermal-resistance-reducing element 22. In such a case, a metal plate, for example, may be arranged to surround the contact portion between the pipe-side plate 2 and the refrigerant pipe 43 to block rainwater and snow and prevent the contact portion from being exposed to the outside.

When the refrigerant pipe 43 is made of aluminum and the pipe-side plate 2 is also made of aluminum, an aluminum brazing structure obtained by superheating aluminum solder serving as the thermal-resistance-reducing element 22 may be provided instead of using, for example, the above-described thermal grease. By performing brazing, the thermal resistance can be further reduced as compared with the case of using the thermal grease or heat radiation sheet. Galvanic corrosion occurs due to the difference in ionization tendency between copper and aluminum. Therefore, no problem occurs in the brazing structure in which the refrigerant pipe 43 and the pipe-side plate 2 are both made of aluminum, and requirements on a rainproof structure, for example, for preventing galvanic corrosion can be relaxed.

The refrigerant pipe 43 will now be described. Referring to FIG. 6, a portion or all of the refrigerants used in the refrigeration cycle of the air-conditioning apparatus 1 flow through the refrigerant pipe 43. The refrigerant pipe 43 is arranged so that a straight portion thereof is in contact with the pipe-side plate 2 with a small thermal resistance therebetween. The refrigerant pipe 43 may be bent, for example, to form a U-shaped bent portion so that the refrigerant pipe 43 includes a plurality of straight portions that are in contact with the pipe-side plate 2. The refrigerant pipe 43 is preferably made of aluminum or copper. The refrigerant pipe 43 preferably has a circular, flat tube or a flat shape so that the contact area the pipe-side plate 2 and the refrigerant pipe 43 can be increased.

Figure 9:
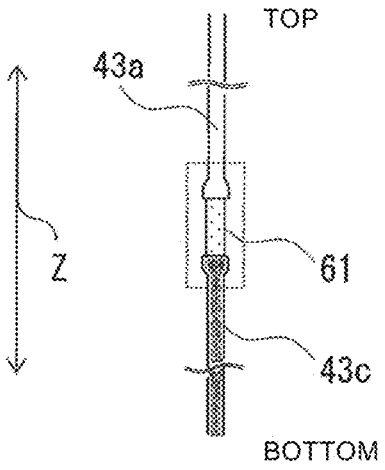
FIG. 9 illustrates the positional relationship between refrigerant pipes including a pipe formed of aluminum and a pipe formed of copper in the direction of gravity in the air-conditioning apparatus according to Embodiment 1 of the present invention.

FIG. 9 illustrates the positional relationship between refrigerant pipes including a pipe formed of an aluminum material and a pipe formed of a copper material in the direction of gravity in the air-conditioning apparatus according to Embodiment 1 of the present invention. A configuration including both a copper pipe 43*c* and an aluminum pipe 43*a* as refrigerant pipes 43 will now be described. In general, the refrigerant pipes 43 of the air-conditioning apparatus 1 are often made of copper. When the aluminum pipe 43*a* made of aluminum is used as the aluminum pipe 43 for the cooler, the aluminum pipe 43*a* needs to be connected to the copper pipe 43*c* to use a portion or all of the refrigerants used in the air-conditioning apparatus 1. In this case, to prevent moisture that has come into contact with the copper pipe 43*c* and contains copper ions from moving downward due to gravity and reaching the aluminum pipe 43*a*, the aluminum pipe 43*a* needs to be disposed above the copper pipe 43*c*. When there is a possibility that moisture such as dew or rainwater will come into contact, the aluminum pipe 43*a* formed of an aluminum element is disposed above the copper pipe 43*c* formed of a copper element in the direction of gravity (Z-axis direction), as illustrated in FIG. 9, to prevent quality degradation due to galvanic corrosion. The pipes are generally connected to each other by brazing to prevent leakage of the refrigerant. However, copper and aluminum cannot be easily brazed together because of the large difference in melting point. Accordingly, an SUS pipe 61 (stainless steel pipe) is provided between the copper pipe 43*c* and the aluminum pipe 43*a* to connect the copper pipe 43*c* and the aluminum pipe 43*a* to each other. Alternatively, a Swagelok coupling or a ball valve may be used. According to the above-described configuration, the occurrence of galvanic corrosion of the aluminum pipe 43*a* can be reduced.

Figure 10:
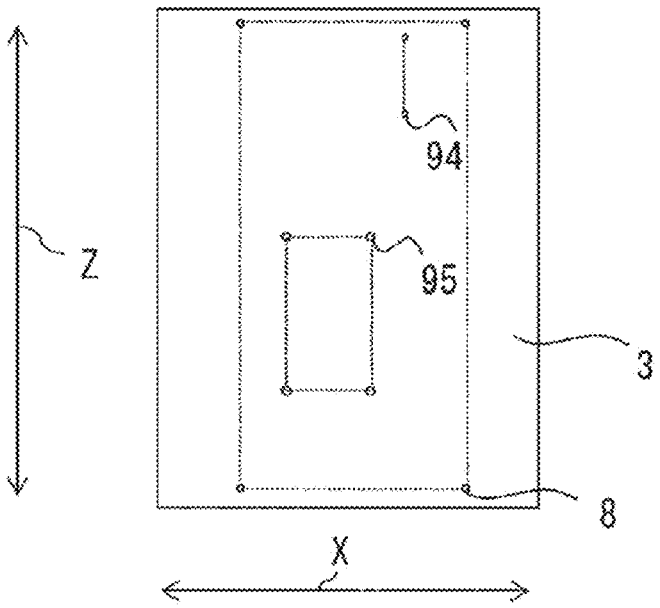
FIG. 10 is a front view of a control box-side plate attached to the control box in the air-conditioning apparatus according to Embodiment 1 of the present invention.

FIG. 10 is a front view of the control box-side plate attached to the control box in the air-conditioning apparatus according to Embodiment 1 of the present invention. The control box-side plate 3 will now be described with reference to FIGS. 6, 7, and 10. As illustrated in FIG. 6, the control box-side plate 3 is in contact with and thermally connected to the pipe-side plate 2.

Similar to the pipe-side plate 2, the control box-side plate 3 is, for example, a flat rectangular-shaped plate made of a metal, such as aluminum or copper. To prevent galvanic corrosion between the control box-side plate 3 and the pipe-side plate 2, the same material as that of the pipe-side plate 2 is preferably selected as the material of the control box-side plate 3.

As illustrated in FIG. 10, the control box-side plate 3 has fixing-element holes 8 used to fix the control box-side plate 3 to the control box 5. The control box-side plate 3 is fixed to the control box 5 by screwing fixing elements 14 into the fixing-element holes 8 in the control box-side plate 3 from the inside of the control box 5. To make the control box 5 rainproof, the fixing-element holes 8 are not formed as through holes and the fixing elements 14 are fastened from the inside of the control box 5. The fixing elements 14 may be, for example, metric screws or tapping screws, and the fixing-element holes 8 are formed in a shape that matches the shape of the fixing elements 14. The control box-side plate 3 also has heating-element fixing holes 94 or heating-element fixing holes 95 used to fix the heating element 4. As illustrated in FIG. 6; the heating element 4 is fixed to the heating-element fixing holes 94 or the heating-element fixing holes 95 by the fixing elements 200.

Referring to FIG. 6 again, the manner in which the pipe-side plate 2 and the control box-side plate 3 are connected will now be described. A thermal-resistance-reducing element 16 is disposed between the pipe-side plate 2 and the control box-side plate 3 to reduce thermal resistances. The thermal-resistance-reducing element 16 is, for example, thermal grease or a heat dissipation sheet. The thermal-resistance-reducing element 16 may be attached to either one of the pipe-side plate 2 and the control box-side plate 3 during assembly. However, the thermal-resistance-reducing element 16 is preferably attached to the control box-side plate 3 to facilitate work when the thermal-resistance-reducing element 16 is damaged or needs to be replaced.

The thermal-resistance-reducing element 16, which is thermal grease or a heat radiation sheet, may have various levels of hardness and thickness depending on the type thereof. First, the hardness of the thermal-resistance-reducing element 16 will be discussed. When the thermal-resistance-reducing element 16 has a low hardness, the pipe-side plate 2 and the control box-side plate 3 can be tightly joined together. This, however, makes it difficult to remove the control box-side plate 3 from the pipe-side plate 2.

Figure 11:
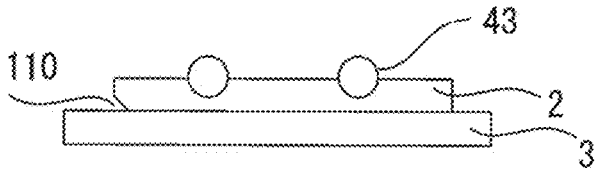
FIG. 11 illustrates a separating unit for separating the pipe-side plate and the control box-side plate from each other in the air-conditioning apparatus according to Embodiment 1 of the present invention.
Figure 12:
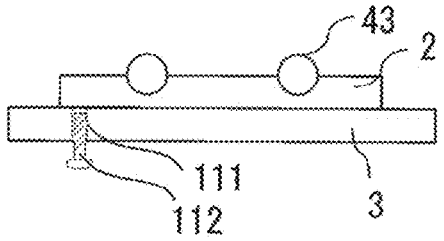
FIG. 12 illustrates another separating unit for separating the pipe-side plate and the control box-side plate from each other in the air-conditioning apparatus according to Embodiment 1 of the present invention.
Figure 13:
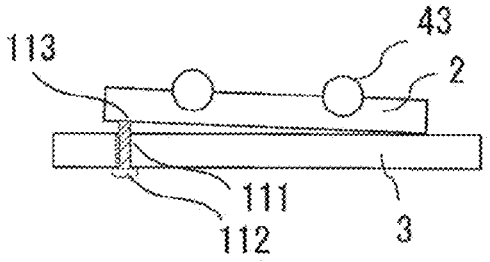
FIG. 13 illustrates the separating unit illustrated in FIG. 12 when a screw is inserted by rotating.

FIG. 11 illustrates separating unit for separating the pipe-side plate and the control box-side plate from each other in the air-conditioning apparatus according to Embodiment 1 of the present invention. FIG. 12 illustrates another separating unit for separating the pipe-side plate and the control box-side plate from each other in the air-conditioning apparatus according to Embodiment 1 of the present invention. FIG. 13 illustrates the separating unit illustrated in FIG. 12 when a screw is inserted by rotating. To remove the control box 5, the pipe-side plate 2 and the control box-side plate 3 are separated from each other so that the control box 5 can be removed. When the pipe-side plate 2 and the control box-side plate 3 are tightly joined together and cannot be easily separated from each other, a cutout 110 may be formed in the pipe-side plate 2, as illustrated in FIG. 11. When the pipe-side plate 2 has the cutout 110, the pipe-side plate 2 and the control box-side plate 3 can be separated from each other by inserting a screwdriver, for example, into the cutout 110. Alternatively, a screw fastening torque may be used as illustrated in FIGS. 12 and 13. A screw hole 111, which is a through hole, is formed in the control box-side plate 3 to extend in the direction from the control box 5 toward the pipe-side plate 2. A screw 112 is inserted by rotating through the screw hole 111 so that a screw contact portion 113 provided at the distal end of the screw presses the pipe-side plate 2 and moves the pipe-side plate 2 away from the control box-side plate 3. Thus, the pipe-side plate 2 and the control box-side plate 3 can be separated from each other.

When a thermal-resistance-reducing element 16 having a high hardness is selected, the pipe-side plate 2 and the control box-side plate 3 are not tightly joined together and can be easily removed from each other. However, since the thermal-resistance-reducing element 16 has a low adhesion, a retaining structure for the thermal-resistance-reducing element 16 needs to be provided when the cooler is arranged perpendicular to the bottom panel 28.

Figure 14:
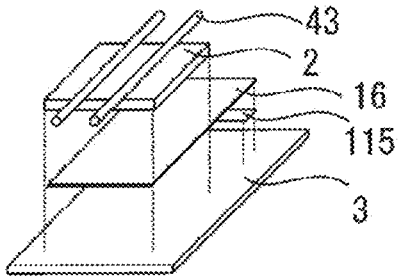
FIG. 14 illustrates a method for fixing a thermal-resistance-reducing element for the cooler in the air-conditioning apparatus according to Embodiment 1 of the present invention.
Figure 15:
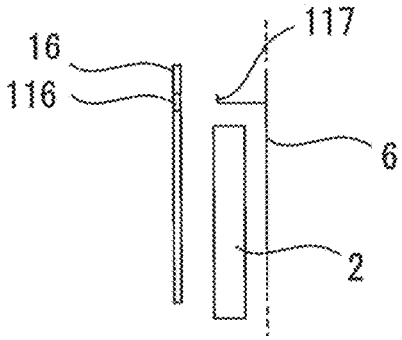
FIG. 15 illustrates another method for fixing the thermal-resistance-reducing element for the cooler in the air-conditioning apparatus according to Embodiment 1 of the present invention.

FIG. 14 illustrates a method for fixing the thermal-resistance-reducing element for the cooler in the air-conditioning apparatus according to Embodiment 1 of the present invention. FIG. 15 illustrates another method for fixing the thermal-resistance-reducing element for the cooler in the air-conditioning apparatus according to Embodiment 1 of the present invention. As illustrated in FIG. 14, the thermal-resistance-reducing element 16 may be bonded to the control box-side plate 3 by placing an adhesive element 115 between the thermal-resistance-reducing element 16 and the control box-side plate 3. Alternatively, as illustrated in FIG. 15, the thermal-resistance-reducing element 16 may be retained by engaging a hook element 117 formed on the positioning element 6 with a hook hole 116 formed in the thermal-resistance-reducing element 16.

A surface of the control box-side plate 3 opposite the pipe-side plate 2 is in contact with heat radiation surfaces of the control box 5 and the heating element 4. The heating element 4 is, for example, an electric component such as an insulated gate bipolar transistor (IGBT) for an inverter or an intelligent power module (IPM). The heating element 4, which is an object to be cooled, may instead be, for example, a rectifying diode, a wire wound component such as a direct-current reactor or a common mode choke coil, a microcomputer, a control integrated circuit (IC) such as a large-scale integrated circuit (LSI), a board pattern, an electrolytic capacitor, or electric wiring. A thermal-resistance-reducing element 18 is disposed between the heating element 4 and the control box-side plate 3 to enable the heating element 4 and the control box-side plate 3 to contact with each other with a small thermal resistance. The thermal-resistance-reducing element 18 may also be thermal silicone or a heat radiation sheet. Since the thermal conductivity increases as the contact area increases, the heating element 4 preferably has a shape that matches the shape of the control box-side plate 3. The shape of the control box-side plate 3 may be changed to match the shape of the heating element 4, and therefore is not limited to the cuboidal shape illustrated in FIG. 10.

Figure 16:
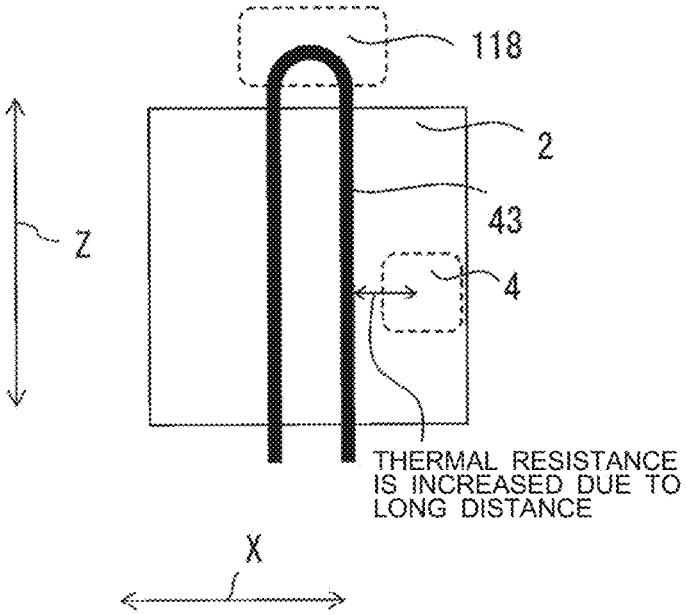
FIG. 16 illustrates the relationship between a refrigerant pipe and the pipe-side plate in the air-conditioning apparatus according to Embodiment 1 of the present invention.
Figure 17:
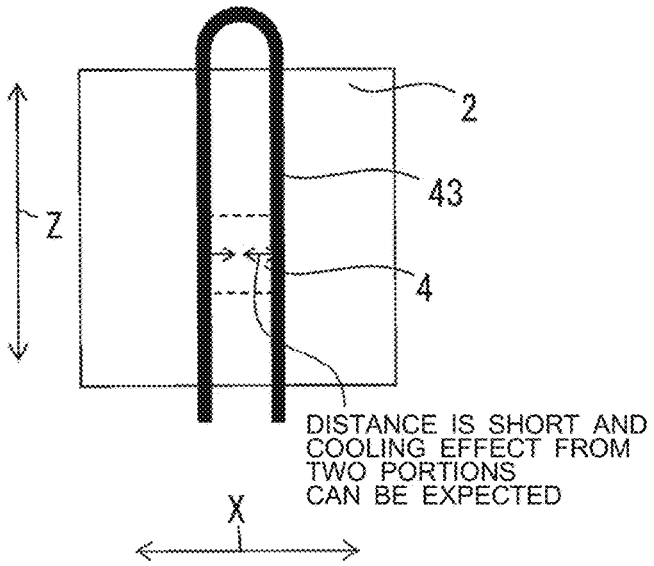
FIG. 17 illustrates a positional relationship in which the refrigerant pipe and a heating element are closer to each other than in the positional relationship illustrated in FIG. 16.

FIG. 16 illustrates the relationship between the refrigerant pipe and the pipe-side plate in the air-conditioning apparatus according to Embodiment 1 of the present invention. FIG. 17 illustrates a positional relationship in which the refrigerant pipe and the heating element are closer to each other than in the positional relationship illustrated in FIG. 16. The extent to which the heating element 4 can be cooled varies depending on the positional relationship between the refrigerant pipe 43 on the pipe-side plate 2 and the heating element 4. Referring to FIG. 16, when the linear distance between the refrigerant pipe 43 and the heating element 4 is long, the thermal resistance is increased. Conversely, the thermal resistance is reduced and the cooling performance is improved as the linear distance between the refrigerant pipe 43 and the heating element 4 is reduced. As illustrated in FIG. 17, the heating element 4 is preferably as close to the refrigerant pipe 43 as possible to reduce the thermal resistance. In particular, when the heating element 4 is positioned to face a plurality of portions of the refrigerant pipe 43, the thermal resistance can be further reduced and the cooling effect can be enhanced. Therefore, when the refrigerant pipe 43 includes a bent portion 118 and has a plurality of portions that face the pipe-side plate 2, the heating element 4 is preferably disposed at a position where high cooling performance can be achieved in consideration of the number of these portions and the distances thereto. To achieve a sufficient reduction in thermal resistance, the thermal-resistance-reducing element 16 needs to be sufficiently compressed, and pressure needs to be applied to the contact surfaces between the components. Accordingly, the refrigerant pipe 43 and the heating element 4 need to be arranged in a constant positional relationship.

Figure 18:
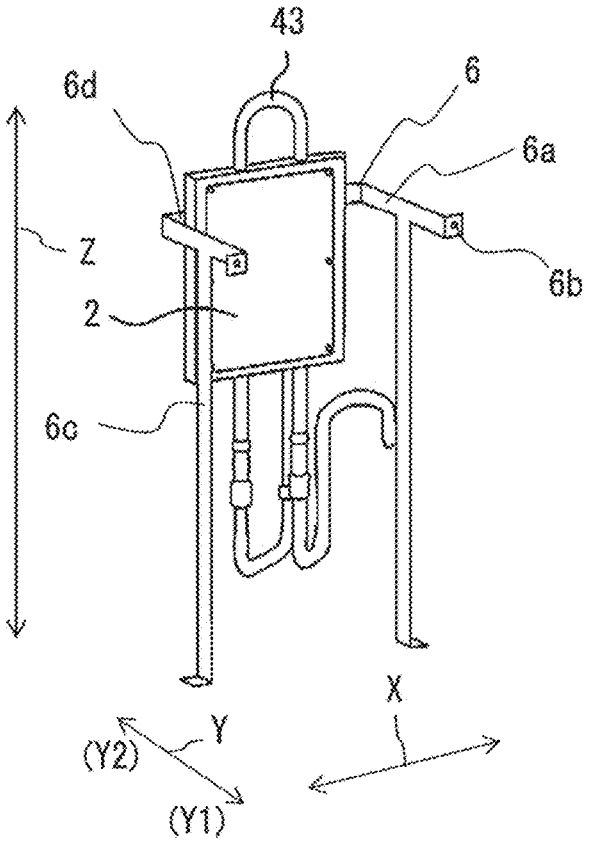
FIG. 18 is a perspective view of a positioning element used to attach the cooler to the control box in the air-conditioning apparatus according to Embodiment 1 of the present invention.

FIG. 18 is a perspective view of the positioning element used to attach the cooler to the control box in the air-conditioning apparatus according to Embodiment 1 of the present invention. The positioning element 6 will now be described with reference to FIGS. 6, 7, and 18, which schematically show the structure of the positioning element 6.

The bent portions 6*b* of the positioning element 6, which are positioned closer to the front portion 5*a* of the control box 5, are fixed to the supports 11 on the control box 5 by the fastening elements 12. The positioning element 6 is fixed to the control box 5 so that the pipe-side plate 2 and the control box 5 are fixed together. The positioning element 6 applies sufficient pressure to the contact surfaces between the components including the refrigerant pipe 43, the pipe-side plate 2, the control box-side plate 3, and the thermal-resistance-reducing elements 16, 18, and 22, and positions the refrigerant pipe 43. The positioning element 6 is made of a metal plate, a metal such as aluminum, or a resin, and is plate-shaped. The positioning element 6 includes a body portion 6*d*, which faces the rear portion 5*d* of the control box 5 and to which the refrigerant pipe 43 and the pipe-side plate 2 are fixed, and the bent portions 6*b* having surfaces that face the work opening 19. The positioning element 6 also includes arm portions 6*a* that connect the body portion 6*d* to the bent portions 6*b* and extend from the positions closer to the rear portion 5*d* toward the front portion 5*a* of the control box 5. The arm portions 6*a* are arranged to extend from the positions closer to the rear portion 5*d* of the control box 5 toward the work opening 19 along the right wall portion 5*b* and the left wall portion 5*c* of the control box 5, so that the bent portions 6*b* are positioned closer to the front portion 5*a* of the control box 5. Thus, the bent portions 6*b* are fixed to the supports 11 at positions closer to the front portion 5*a* of the control box 5.

When the arm portions 6*a* are long, there is a risk that the bent portions 6*b* will be displaced downward due to the weight of the arm portions 6*a* and that the positional relationship between the bent portions 6*b* and the fixing-element holes 11*a* in the supports 11 will change. Accordingly, as illustrated in FIG. 18, fixing leg portions 6*c* may be provided to prevent the displacement in the height direction. The fixing leg portions 6*c* also have a function of securing the pipe-side plate 2 so that the pipe-side plate 2 stands at a predetermined position in the outdoor unit, and may be fixed to the bottom panel 28 of the outdoor unit 100.

The control box 5 and the positioning element 6 are fixed to each other by fastening the supports 11 and the bent portions 6*b* together by using the fastening elements 12. The bent portions 6*b* have fixing-element holes 10 used to fix the bent portions 6*b* to the supports 11 provided on the control box 5. When, for example, the fastening elements 12 are screws, the fixing-element holes 10 are threaded by a burring process. When the fixing-element holes 10 are through holes, the effect similar to that of the burring process can be obtained by using, for example, hexagon head bolts. The body portion 6*d* has fixing holes 13*a* used to screw-fasten the pipe-side plate 2 thereto. The fixing holes 13*a* are arranged to face the fixing-element holes 7 in the pipe-side plate 2.

The positioning element 6 including the arm portions 6*a*, the bent portions 6*b*, and the fixing leg portions 6*c* preferably has a seamless structure obtained by using a single metal plate or by performing a single resin molding process. However, the individual portions of the positioning element 6 may instead be formed separately and then connected together to increase work efficiency. When the individual portions are connected together, the positioning accuracy and inclination thereof need to be appropriately managed at each connecting part. Although the positioning element 6 is thin-frame-shaped in FIG. 18, the shape thereof is not limited as long as sufficient pressure can be applied to the contact surfaces between the components and the refrigerant pipe 43 can be appropriately positioned. The positioning element 6 may be formed in other shapes in consideration of, for example, the material, strength, or heat radiation. For example, the body portion 6*d* may be integrated with the fixing leg portions 6*c* and shaped to partially or entirely cover the rear portion of the control box 5, and the arm portions 6*a* may be integrated with the fixing leg portions 6*c* and shaped to partially or entirely cover the side portions of the control box 5.

The operation of the air-conditioning apparatus 1 having the above-described structure will now be described. First, the air-conditioning apparatus 1 illustrated in FIG. 1 in which the heat exchangers and the cooler are connected in parallel will be described. Referring to FIG. 1, in the cooling operation, the refrigerant flows through the refrigerant circuit 102 along the solid lines in the flow switching device 72. The compressor 71 discharges high-temperature high-pressure gas refrigerant, which passes through the flow switching device 72 and flows into the heat-source-side heat exchanger 75. The refrigerant that has flowed into the heat-source-side heat exchanger 75 exchanges heat with air and is thereby converted into medium-temperature high-pressure liquid refrigerant, which flows out of the heat-source-side heat exchanger 75. The medium-temperature high-pressure liquid refrigerant that has flowed out of the heat-source-side heat exchanger 75 is expanded and reduced in pressure by passing through the refrigerant flow control device 74*a*, and is thereby converted into medium-pressure liquid refrigerant. The refrigerant is further expanded and reduced in pressure by the refrigerant flow control device 74*d*, and is thereby converted into low-temperature low-pressure two-phase gas-liquid refrigerant, which flows into the load-side heat exchanger 73. The refrigerant that has flowed into the load-side heat exchanger 73 exchanges heat with air and is thereby converted into low-temperature low-pressure gas refrigerant, which flows out of the load-side heat exchanger 73. The refrigerant that has flowed out of the load-side heat exchanger 73 passes through the flow switching device 72 and the accumulator 76, and returns to the compressor 71. As a result of the above-described operation, the cooling energy generated by the load-side heat exchanger 73 can be used to, for example, cool an air-conditioned space.

In the refrigerant circuit 103, which branches from the portion between the refrigerant flow control device 74*a* and the refrigerant flow control device 74*d*, the refrigerant that has been expanded and reduced in pressure by passing through the refrigerant flow control device 74*a* and has thereby been converted into low-temperature refrigerant passes through the refrigerant flow control device 74*b* and flows through the refrigerant pipe 43 on the pipe-side plate 2. Accordingly, heat generated by the heating element 4 is transferred to the pipe-side plate 2 through the control box-side plate 3, and is dissipated as a result of heat exchange with the refrigerant in the refrigerant pipe 43 on the pipe-side plate 2. The refrigerant that has exchanged heat with the heating element 4 on the pipe-side plate 2 passes through the refrigerant flow control device 74*c* and the accumulator 76, and returns to the compressor 71. Since two refrigerant flow control devices, which are the refrigerant flow control device 74*a* and the refrigerant flow control device 74*b*, are provided, the pressure of the refrigerant between the refrigerant flow control devices can be set to a medium pressure, and the temperature of the cooler can be adjusted to any temperature between the high-pressure-side and low-pressure-side temperatures.

Referring to FIG. 1, in the heating operation, the refrigerant flows through the refrigerant circuit 102 along the dotted lines in the flow switching device 72. The compressor 71 discharges high-temperature high-pressure gas refrigerant, which passes through the flow switching device 72 and flows into the load-side heat exchanger 73. The refrigerant that has flowed into the load-side heat exchanger 73 exchanges heat with air and is thereby converted into medium-temperature high-pressure liquid refrigerant, which flows out of the load-side heat exchanger 73. The medium-temperature high-pressure liquid refrigerant that has flowed out of the load-side heat exchanger 73 passes through the refrigerant flow control device 74*d*. Then, the refrigerant is expanded and reduced in pressure by the refrigerant flow control device 74*a*, and is thereby converted into low-temperature low-pressure two-phase gas-liquid refrigerant, which flows into the heat-source-side heat exchanger 75. The refrigerant that has flowed into the heat-source-side heat exchanger 75 exchanges heat with air and is thereby converted into low-temperature low-pressure gas refrigerant, which flows out of the heat-source-side heat exchanger 75. The refrigerant that has flowed out of the heat-source-side heat exchanger 75 passes through the flow switching device 72 and the accumulator 76, and returns to the compressor 71. As a result of the above-described operation, the heating energy generated by the load-side heat exchanger 73 can be used to, for example, cool the air-conditioned space.

In the refrigerant circuit 103, which branches from the portion between the flow switching device 72 and the load-side heat exchanger 73, the refrigerant is expanded and reduced in pressure by passing through the refrigerant flow control device 74*c*, and is thereby converted into low-temperature refrigerant, which flows through the refrigerant pipe 43 on the pipe-side plate 2. Accordingly, heat generated by the heating element 4 is transferred to the pipe-side plate 2 through the control box-side plate 3, and is dissipated as a result of heat exchange with the refrigerant in the refrigerant pipe 43 on the pipe-side plate 2. The refrigerant that has exchanged heat with the heating element 4 on the pipe-side plate 2 passes through the refrigerant flow control device 74*b* and enters the refrigerant circuit 102 at the position between the refrigerant flow control device 74*a* and the refrigerant flow control device 74*d*.

The air-conditioning apparatus 1*a* illustrated in FIG. 2 in which the heat exchangers and the cooler are connected in series will now be described. Referring to FIG. 2, in the cooling operation, the refrigerant flows through the refrigerant circuit 104 along the solid lines in the flow switching device 72. The compressor 71 discharges high-temperature high-pressure gas refrigerant, which passes through the flow switching device 72 and flows into the heat-source-side heat exchanger 75. The refrigerant that has flowed into the heat-source-side heat exchanger 75 exchanges heat with air and is thereby converted into medium-temperature high-pressure liquid refrigerant, which flows out of the heat-source-side heat exchanger 75. The medium-temperature high-pressure liquid refrigerant that has flowed out of the heat-source-side heat exchanger 75 is expanded and reduced in pressure by passing through the refrigerant flow control device 74*a*, and flows through the refrigerant pipe 43 on the pipe-side plate 2. The refrigerant that has exchanged heat with the heating element 4 on the pipe-side plate 2 passes through the refrigerant flow control device 74*e*. Then, the refrigerant is expanded and reduced in pressure by the refrigerant flow control device 74*d*, and is thereby converted into low-temperature low-pressure two-phase gas-liquid refrigerant, which flows into the load-side heat exchanger 73. The refrigerant that has flowed into the load-side heat exchanger 73 exchanges heat with air and is thereby converted into low-temperature low-pressure gas refrigerant, which flows out of the load-side heat exchanger 73. The refrigerant that has flowed out of the load-side heat exchanger 73 passes through the flow switching device 72 and the accumulator 76, and returns to the compressor 71.

Referring to FIG. 2, in the heating operation, the refrigerant flows through the refrigerant circuit 104 along the dotted lines in the flow switching device 72. The compressor 71 discharges high-temperature high-pressure gas refrigerant, which passes through the flow switching device 72 and flows into the load-side heat exchanger 73. The refrigerant that has flowed into the load-side heat exchanger 73 exchanges heat with air and is thereby converted into medium-temperature high-pressure liquid refrigerant, which flows out of the load-side heat exchanger 73. The medium-temperature high-pressure liquid refrigerant that has flowed out of the load-side heat exchanger 73 passes through the refrigerant flow control device 74*d*. Then, the refrigerant is expanded and reduced in pressure by passing through the refrigerant flow control device 74*e*, and flows through the refrigerant pipe 43 on the pipe-side plate 2. The refrigerant that has exchanged heat with the heating element 4 on the pipe-side plate 2 is expanded and reduced in pressure by the refrigerant flow control device 74*a*, and is thereby converted into low-temperature low-pressure two-phase gas-liquid refrigerant, which flows into the heat-source-side heat exchanger 75. The refrigerant that has flowed into the heat-source-side heat exchanger 75 exchanges heat with air and is thereby converted into low-temperature low-pressure gas refrigerant, which flows out of the heat-source-side heat exchanger 75. The refrigerant that has flowed out of the heat-source-side heat exchanger 75 passes through the flow switching device 72 and the accumulator 76, and returns to the compressor 71.

During the cooling operation of the air-conditioning apparatus 1*a*, the refrigerant is condensed by the heat-source-side heat exchanger 75, and the temperature and flow rate thereof are adjusted by the refrigerant flow control device 74*a* so that the temperature of the refrigerant that flows through the refrigerant pipe 43 on the pipe-side plate 2 is lower than the temperature of the heating element 4. During the heating operation, the refrigerant is condensed by the load-side heat exchanger 73, and the temperature and flow rate thereof are adjusted by, for example, the refrigerant flow control devices 74*d* and 74*e* so that the temperature of the refrigerant that flows through the refrigerant pipe 43 on the pipe-side plate 2 is lower than the temperature of the heating element 4. Accordingly, heat generated by the heating element 4 is transferred to the pipe-side plate 2 through the control box-side plate 3, and is rejected as a result of heat exchange with the refrigerant in the refrigerant pipe 43 on the pipe-side plate 2.

The temperature and flow rate of the refrigerant and the condition of the refrigerant will now be described as parameters that affect the cooling performance of the refrigerant. The cooling performance increases as the temperature of the refrigerant that flows into the refrigerant pipe 43 on the pipe-side plate 2 decreases, and decreases as the temperature of the refrigerant increases. The cooling performance increases as the flow rate of the refrigerant that flows into the refrigerant pipe 43 on the pipe-side plate 2 increases, and decreases as the temperature of the refrigerant decreases. The cooling performance increases as the amount of liquid in the refrigerant that flows into the refrigerant pipe 43 on the pipe-side plate 2 increases, and decreases as the amount of gas in the refrigerant increases.

The temperature and flow rate of the refrigerant greatly vary depending on the structure of the refrigerant circuit. In the refrigeration cycle illustrated in FIG. 1, the refrigerant flows through the refrigerant circuit 103 branching from the refrigerant circuit 102, which is the main refrigeration cycle of the air-conditioning apparatus 1. Since the performance of the air-conditioning apparatus 1 will be degraded if a large amount of refrigerant is supplied to the refrigerant circuit 103, the flow rate of the refrigerant supplied to the refrigerant circuit 103 is limited. Accordingly, low-temperature refrigerant flows through the refrigerant pipe 43 on the pipe-side plate 2 at a low flow rate. In contrast, in the refrigeration cycle illustrated in FIG. 2, all of the high-temperature high-pressure refrigerant flows through the refrigerant circuit 104 of the air-conditioning apparatus 1*a*. Accordingly, high-temperature refrigerant flows through the refrigerant pipe 43 on the pipe-side plate 2 at a high flow rate.

A method for attaching the positioning element 6 for positioning and securing the pipe-side plate 2 will now be described. First, the fixing elements 13 are inserted through the fixing holes 13*a* and into the fixing-element holes 7 formed in the pipe-side plate 2 to attach the positioning element 6 to the fixing-element holes 7. Accordingly, the pipe-side plate 2 and the positioning element 6 are fixed together and prevented from being separated from each other when the control box 5 is removed. Next, the bent portions 6*b* are positioned so that fixing clearances 24 are secured between the bent portions 6*b* and the supports 11, which are provided on the control box 5 at positions closer to the work opening 19. Then, the bent portions 6*b* and the supports 11 are fastened together by using the fastening elements 12.

Figure 19:
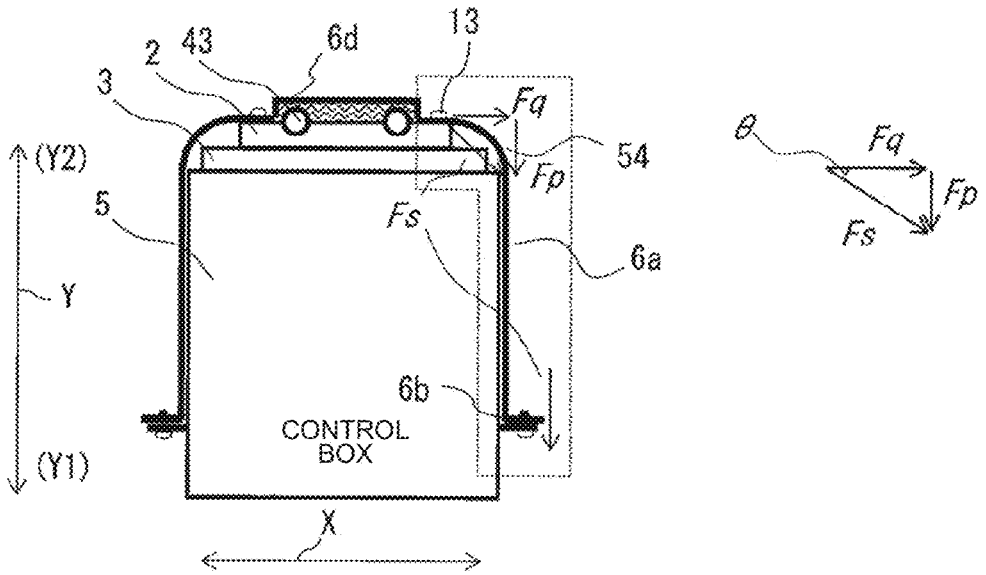
FIG. 19 illustrates forces applied to the positioning element in the air-conditioning apparatus according to Embodiment 1 of the present invention.

FIG. 19 illustrates forces applied to the positioning element in the air-conditioning apparatus according to Embodiment 1 of the present invention. The method for estimating an effective pressing force Fp applied by the fastening elements 12 will now be described. When the bent portions 6*b* and the supports 11 are fastened together by using the fastening elements 12, tensile force Fs is generated, as illustrated in FIG. 19. The tensile force Fs is applied to portions fixed by each fixing element 13, and is basically divided into two vector components since the positioning element 6 is bent at bent portions 54. Here, the vector component that is parallel to the surfaces of the pipe-side plate 2 and the control box-side plate 3 is referred to as ineffective pressing force Fq, and the vector component that is perpendicular to the surfaces of the pipe-side plate 2 and the control box-side plate 3 is referred to as effective pressing force Fp. An angle θ formed by the two force vectors is referred to as angle θ. These parameters vary depending on the bending manner, the shape, and the rigidity of the positioning element 6 to be precise. Accordingly, a simplest example will be discussed herein. The effective pressing force Fp can be expressed as follows.

[Math.1]

$$Fp^2+Fq^2=Fs^2 \tag{1}$$

[Math.2]

$$Fp=\sqrt{Fs^2-Fq^2} \tag{2}$$

[Math. 3]

$$Fp=Fs \sin \theta \tag{3}$$

When θ is 90 degrees, the following mathematical equation is satisfied.

[Math. 4]

$$Fp=Fs \tag{4}$$

Math. 2 shows that the effective pressing force Fp can be increased to reduce the thermal resistance by reducing the ineffective pressing force Fq. When the strength of the positioning element 6 is increased, the size of the bent portions can be reduced to increase the angle θ, so that the effective pressing force Fp approaches the tensile force Fs, as is clear from Math. 2. When θ is 90 degrees, Fp is equal to Fs and the force applied by the fastening elements 12 can be efficiently used to achieve surface contact.

Figure 20:
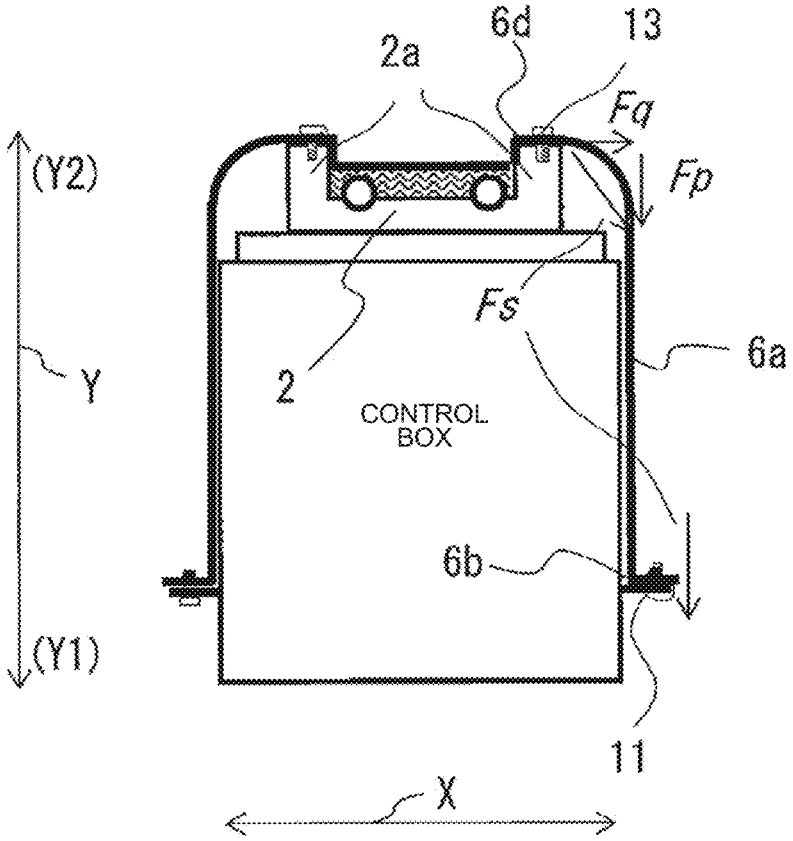
FIG. 20 illustrates forces applied to another positioning element in the air-conditioning apparatus according to Embodiment 1 of the present invention.

FIG. 20 illustrates forces applied to another positioning element in the air-apparatus according to Embodiment 1 of the present invention. Referring to FIG. 20, to position the fixing elements 13 farther in the depth direction (Y-axis direction), the pipe-side plate 2 is formed to include projecting portions 2*a* that project toward the rear surface of the housing 80 and that are fixed to the positioning element 6, and is shaped such that the pipe-side plate 2 is thick in the depth direction. From a structural point of view, the formed angle θ can be increased by increasing the distance from the bent portions 6*b* to the fixing elements 13, as illustrated in FIG. 20, and the effective pressing force Fp can be increased accordingly. In FIG. 20, the shape of the pipe-side plate 2 is changed to position the fixing elements 13 farther in the depth direction (Y-axis direction). However, the basic requirement is to increase the distance from the bent portions 6*b* to the fixing elements 13. Therefore, the shape of the positioning element 6 may instead be changed without changing the shape of the pipe-side plate 2. Alternatively, the distance from the bent portions 6*b* to the fixing elements 13 may be increased by placing a robust resin or metal element between the positioning element 6 and the pipe-side plate 2.

Figure 21:
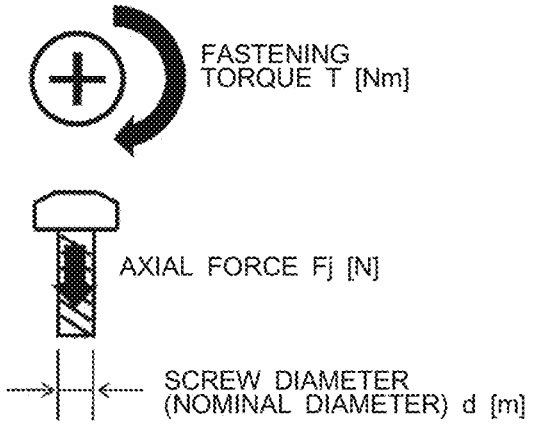
FIG. 21 illustrates a screw fastening torque and an axial force applied to a screw used in the air-conditioning apparatus according to Embodiment 1 of the present invention.

FIG. 21 illustrates a screw fastening torque and an axial force applied to a screw used in the air-conditioning apparatus according to Embodiment 1 of the present invention. An example of the tensile force Fs will now be described. The fastening elements 12 used to generate the tensile force Fs may be, for example, metric screws. To facilitate calculation, it is assumed that M5 screws are used. However, the fastening elements 12 are not limited to screws. A fastening torque T [Nm] applied to a screw differs depending on the size of the screw. As the diameter of the screw increases, the fastening torque T increases and the axial force Fj [N] also increases accordingly. The fastening torque T is also affected by the processing accuracy, for example, the roughness of the bearing surface. The relationship between the fastening torque T and the axial force Fj is generally as follows.

[Math. 5]

$$T = kdFj \tag{5}$$

[Math. 6]

$$Fj = \frac{T}{kd} \tag{6}$$

Here, k is a so-called torque coefficient, which is generally set to a value less than 0.3, and d is the screw diameter (nominal diameter) [m]. The fastening torque T of an M5 screw is about 3 Nm. Therefore, when the torque coefficient k is 0.2, the axial force Fj applied to a single M5 screw, for example, can be calculated as about 3000 [N].

[Math. 7]

$$Fj = \frac{T}{kd} = \frac{3[\mathrm{Nm}]}{0.2 \times 0.005[\mathrm{m}]} = 3000[\mathrm{N}] \tag{7}$$

The relationship between the fastening elements 12 and the thermal-resistance-reducing element 16 for reducing the thermal resistance will now be described in detail. The thermal-resistance-reducing element 16 may be, for example, thermal grease or a heat dissipation sheet, and the relationship between pressure and thermal resistance is generally provided by the manufacturer thereof. Since pressure is determined by force and area, the pressure applied to the surface by the screws can be determined by the force (axial force Fj×number of fastening elements 12) and the area of the thermal-resistance-reducing element 16. When the pressure is determined, the thermal resistance can be estimated based on the relationship between pressure and thermal resistance. The number of screws (number of fastening elements 12) needs to be set to a sufficiently large number in consideration of the difference in temperature between the heating element 4 and the refrigerant and thermal resistance elements disposed between the heating element 4 and the refrigerant (the refrigerant pipe 43, brazing surfaces, the pipe-side plate 2, the control box-side plate 3, and the thermal-resistance-reducing elements 16, 18, and 22).

As described above, the bent portions 6*b* of the positioning element, which are fixed to the control box 5 by the fastening elements 12, are positioned closer to the front portion 5*a* of the control box 5. Thus, even when the cooler is disposed behind the control box 5 as viewed from the position of the operator who replaces the control box 5, the operator can easily access the positions at which the positioning element 6 is fixed to the control box 5, and the control box 5 can be easily attached to or removed from the cooler.

The outdoor unit 100 is structured such that the fan unit 33 is disposed in an upper section of the outdoor unit 100, that the heat exchange unit 38 is disposed below the fan unit 33, that the machine unit 39 is disposed below the heat exchange unit 38, and that the machine unit 39 includes the heating element to be cooled. In this case, since the fan unit 33 generally blows air toward the region above the unit, air is sucked in from the region around the heat exchange unit 38 and is caused to flow upward. Therefore, substantially no airflow occurs in the machine unit 39. Since excessive air that does not contribute to heat exchange is not sucked in, the heat exchange efficiency of the air-conditioning apparatus can be increased. In addition, dust, dirt, and snow can be prevented from being sucked in together with air, and the quality can be improved accordingly.

Embodiment 2

Figure 22:
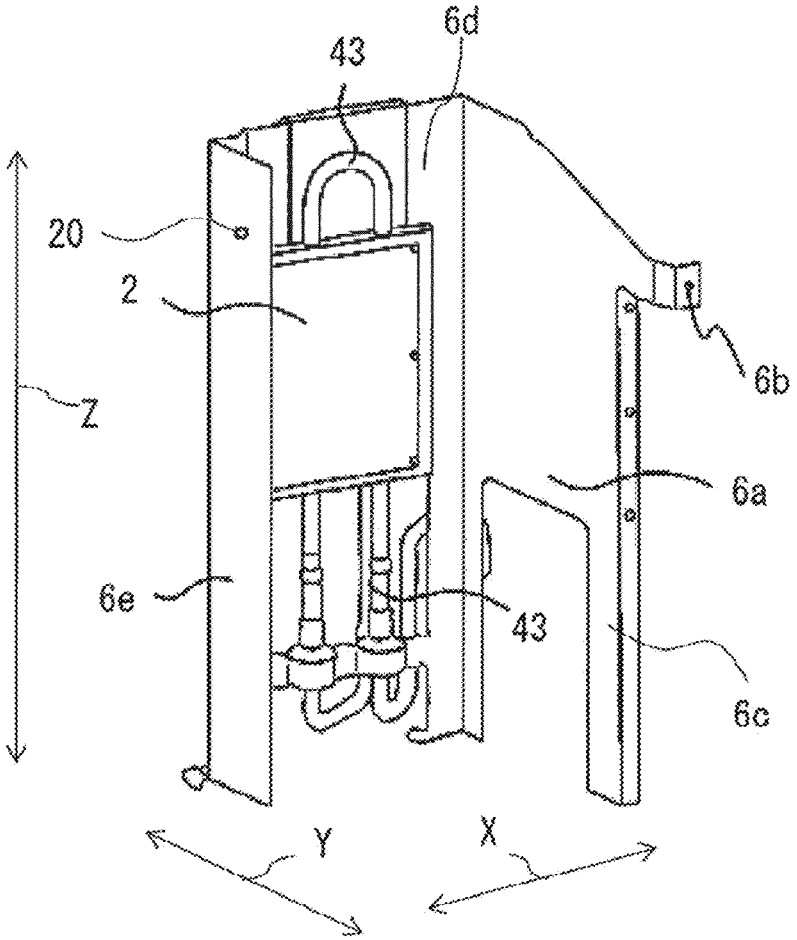
FIG. 22 is a perspective view of a positioning element used to attach a cooler to a control box in an air-conditioning apparatus according to Embodiment 2 of the present invention.
Figure 23:
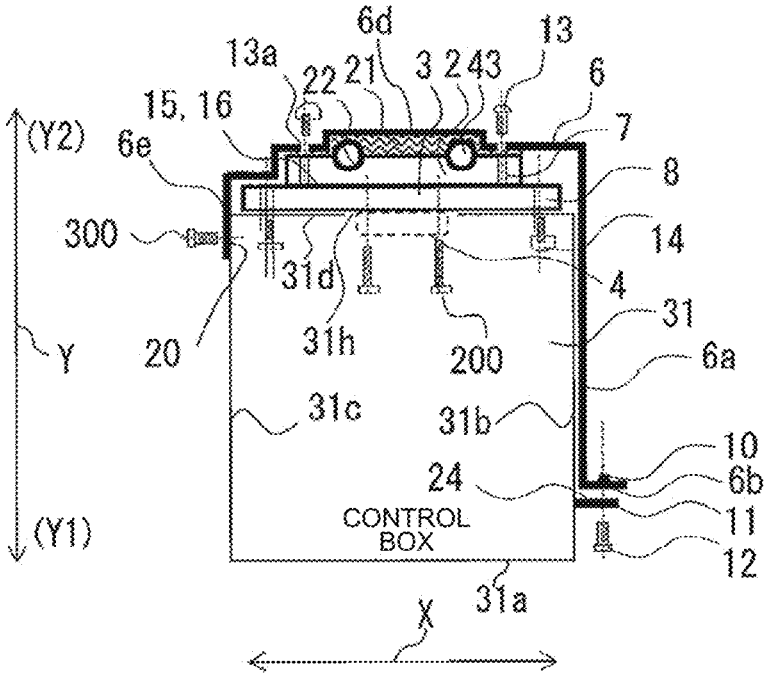
FIG. 23 is a simplified plan view of an attachment structure for attaching the cooler to the control box installed in the air-conditioning apparatus according to Embodiment 2 of the present invention.

FIG. 22 is a perspective view of a positioning element used to attach a cooler to a control box in an air-conditioning apparatus according to Embodiment 2 of the present invention. FIG. 23 is a simplified plan view of an attachment structure for attaching the cooler to the control box installed in the air-conditioning apparatus according to Embodiment 2 of the present invention. Components having the same configurations as those in the air-conditioning apparatus illustrated in FIGS. 1 to 21 are denoted by the same reference symbols, and description thereof is omitted. In the air-conditioning apparatus 1 according to Embodiment 1 of the present invention, as illustrated in FIG. 3, no work space is provided on either of the left and right sides (sides in the X-axis direction) of the control box 5 as viewed from the work opening 19. Therefore, the fastening elements 12 are fastened from the work opening 19 at both the left and right sides of the control box 5 to reliably bring the pipe-side plate 2 and the control box-side plate 3 into contact with each other at a position closer to the front portion 5*a* of the control box 5 even when there is no work space into which the operator can insert their hands. In the air-conditioning apparatus 1 according to Embodiment 2 of the present invention, it is assumed that a work space is provided at one of the left and right sides (sides in the X-axis direction) of the control box 31 and that the pipe-side plate 2 and the control box-side plate 3 can be reliably brought into contact with each other by fixation at only one side. Such a structure will now be described with reference to FIGS. 3 to 7, 22, and 23.

Only the difference of Embodiment 2 of the present invention from the air-conditioning apparatus 1 will be described. The control box 31 is rectangular-parallelepiped-shaped. A front portion 31*a* of the control box 31 is positioned closer to the work opening 19 in the housing 80, and a rear portion 31*d* of the control box 31 is positioned closer to the rear panel 32*c* of the housing 80. A right wall portion 31*b* of the control box 31 is positioned closer to the right panel 32*a* of the housing 80, and a left wall portion 31*c* of the control box 31 is positioned closer to the left panel 32*b* of the housing 80. The bottom surface of the control box 31 is placed on the bottom panel 28, and the top surface of the control box 31 is positioned closer to the top inside surface of the machine unit 39. A support 11 is provided on the right wall portion 31*b* at a position closer to the front portion 31*a* of the control box 31. Similar to the control box 5, the control box 31 may have other shapes. The pipe-side plate 2 is placed behind the rear portion 31*d* of the control box 31. The control box 31 is thermally connected to the pipe-side plate 2 through the control box-side plate 3. As illustrated in FIG. 23, the rear portion 31*d* (Y2-side portion) of the control box 31 has a control box opening 31*h* that enables the heating element 4 to be in contact with the control box-side plate 3. It is not essential that the control box opening 31*h* be formed, and the rear portion 31*d* of the control box 31 may be disposed between the heating element 4 and the control box-side plate 3.

The positioning element 6 includes a side wall portion 6*e* that partially or entirely covers the left wall portion 31*c* of the control box 31 around which the work space is provided. The side wall portion 6*e* has no arm portion 6*a* or bent portion 6*b*, and has a side-wall-fixing-element hole 20 used to fix the side wall portion 6*e* to the left wall portion 31*c* of the control box 31. Although a single side-wall-fixing-element hole 20 is formed in an upper section of the side wall portion 6*e* in FIG. 22, the number and positions of side-wall-fixing-element holes 20 are not limited, and may be determined in consideration of, for example, the material and strength. Referring to FIG. 23, a side-wall-fixing element 300 can be fastened to the side-wall-fixing-element hole 20 because a work space is provided on the left side as viewed from the work opening 19. Similar to the air-conditioning apparatus according to Embodiment 1 of the present invention, a right arm portion 6*a* has a bent portion 6*b* at a position closer to the work opening 19. The pipe-side plate 2 and the control box-side plate 3 can be reliably brought into contact with each other by fixing the bent portion 6*b* to the support 11 provided on the right wall portion 31*b* by a fastening element 12. Although the arm portion 6*a* is provided only at the right side in FIG. 22, a structure is also possible that that the side wall portion 6*e* is provided at the right side and the arm portion 6*a* is provided at the left side depending on the position of the work space.

The positioning element 6 may be fixed to the control box 31 at the side where the side wall portion 6*e*, which has no arm portion 6*a*, is provided first and then at the side where the arm portion 6*a* is provided. In such a case, displacement between the holes for the side-wall-fixing element 300 can be prevented.

Since the positioning element 6 may include the arm portion 6*a* only at one side when a work space is provided, the material cost of a portion of the positioning element 6 at the side where the work space is provided can be reduced. Accordingly, the overall cost can be reduced. In addition, even when the cooler is disposed behind the control box 31 as viewed from the position of the operator who replaces the control box 31, the operator can easily access the positions at which the positioning element 6 is fixed to the control box 31, and the control box 31 can be easily attached to or removed from the cooler.

Embodiment 3

Figure 24:
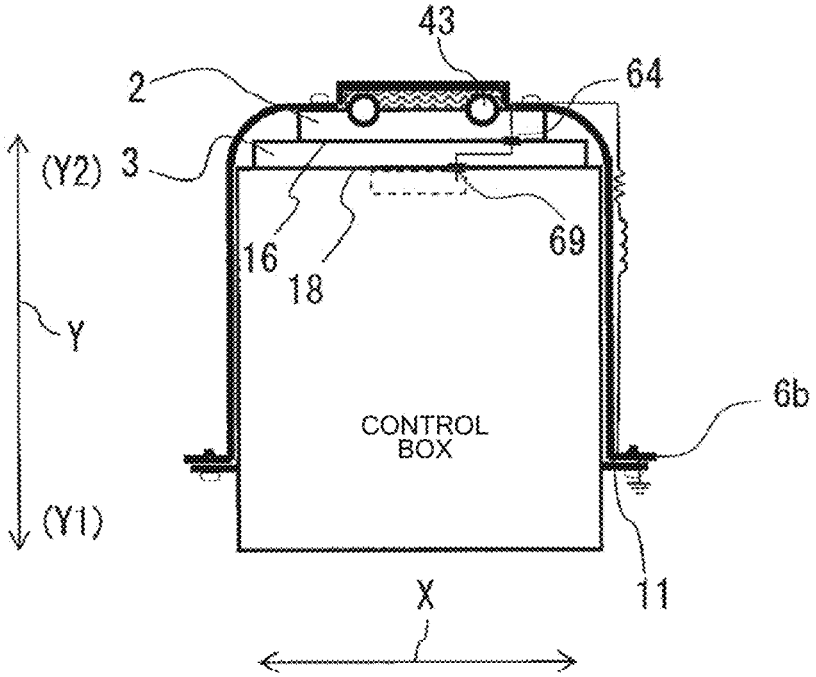
FIG. 24 illustrates the grounding effect of a metal plate that constitutes a positioning element in an air-conditioning apparatus according to Embodiment 3 of the present invention.

FIG. 24 illustrates the grounding effect of a metal plate that constitutes a positioning element in an air-conditioning apparatus according to Embodiment 3 of the present invention. When the positioning element 6 is made of a metal, radiation noise that is transmitted through the refrigerant pipe 43 and radiated from the refrigerant pipe 43 serving as an antenna can be reduced. FIG. 24 illustrates the path of the noise. Since the heat rejecting elements, such as the thermal-resistance-reducing element 16 and the thermal-resistance-reducing element 18, are insulating elements, there is a risk that a capacitor 64 and a capacitor 69 will be formed. High-frequency noise generated by the capacitor 64 and the capacitor 69 is transmitted to the refrigerant pipe 43, which has a low impedance.

Accordingly, a ground wire may be used to ground the pipe-side plate 2. However, when the positioning element 6 is formed of a metal, the pipe-side plate 2 can be electrically grounded through the control box 5 or 31 by fixing the bent portions 6*b* to the supports 11. Alternatively, the positioning element 6 may be grounded through the fixing leg portions 6*c* of the positioning element 6. In such a case, the noise is not transmitted to the refrigerant pipe 43, and the radiation noise can be reduced accordingly. Thus, in the air-conditioning apparatus according to Embodiment 3 of the present invention, it is not necessary to use an additional noise reducing element, and the cost can be reduced. In addition, the control box 5 or 31 can be easily attached to or removed from the cooler.

Embodiments of the present invention are not limited to Embodiments 1 to 3 described above. For example, although the outdoor unit 100 included in the air-conditioning apparatus according to Embodiment 1 of the present invention is a so-called top-flow outdoor unit that sucks in air through a side surface of the housing 80 and blows out air through the air outlet 29 at the top of the housing 80, the present invention is not limited to this. In addition, although an explanation is made above taking an outdoor unit of an air-conditioning apparatus as an example, the cooler may also be used in any other apparatus that includes a refrigeration cycle in which refrigerant is used, such as a refrigeration device or an indoor unit.

REFERENCE SIGNS LIST

1 air-conditioning apparatus 1*a* air-conditioning apparatus 2 pipe-side plate 2*a* projecting portion 3 control box-side plate 4 heating element 5 control box 5*a* front portion 5*b* right wall portion 5*c* left wall portion 5*d* rear portion 5*h* control box opening 6 positioning element 6*a* arm portion 6*b* bent portion 6*c* fixing leg portion 6*d* body portion 6*e* side wall portion 7 fixing-element hole 8 fixing-element hole 10 fixing-element hole 11 support 11*a* fixing-element hole 12 fastening element 13 fixing element 13*a* fixing hole 14 fixing element 15 contact surface 16 thermal-resistance-reducing element 18 thermal-resistance-reducing element 19 work opening 20 side-wall-fixing-element hole 21 heat insulating element 22 thermal-resistance-reducing element 24 fixing clearance 25 front panel 26 fin guard 27 fan guard 28 bottom panel 29 air outlet 30 fan 31 control box 31*a* front portion 31*b* right wall portion 31*c* left wall portion 31*d* rear portion 31*h* control box opening 32*a* right panel 32*b* left panel 32*c* rear panel 33 fan unit 34 fan motor 35 heat exchanger fin 38 heat exchange unit 39 machine unit 43 refrigerant pipe 43*a* aluminum pipe 43*c* copper pipe 54 bent portion 61 SUS pipe 64 capacitor 69 capacitor 71 compressor 72 flow switching device 73 load-side heat exchanger 74*a* refrigerant flow control device 74*b* refrigerant flow control device 74*c* refrigerant flow control device 74*d* refrigerant flow control device 74*e* refrigerant flow control device 75 heat-source-side heat exchanger 76 accumulator 80 housing 91 pipe groove 94 heating-element fixing hole 95 heating-element fixing hole 100 outdoor unit 101 indoor unit 102 refrigerant circuit 103 refrigerant circuit 104 refrigerant circuit 110 cutout 111 screw hole 112 screw 113 screw contact portion 115 adhesive element 116 hook hole 117 hook element 118 bent portion 200 fixing element 300 side-wall-fixing element

The invention claimed is:

1. An air-conditioning apparatus including a refrigeration cycle in which a compressor, a heat-source-side heat exchanger, a refrigerant flow control device, and a load-side heat exchanger are connected, the air-conditioning apparatus comprising:

a refrigerant pipe through which refrigerant that flows through the refrigeration cycle passes;

a pipe-side plate thermally connected to the refrigerant pipe;

a control box thermally connected to the pipe-side plate and containing an electric component including a heating element;

a housing of an outdoor unit, the housing containing the pipe-side plate and the control box;

a positioning element fixing the pipe-side plate and the control box to each other; and a fastening element fixing the control box and the positioning element to each other, wherein at least one side surface of the housing has a work opening, wherein a front portion of the control box is positioned closer to the work opening in the housing, and a rear portion of the control box is positioned closer to a rear surface of the housing, the rear surface facing the side surface having the work opening, wherein the pipe-side plate is disposed between the control box and the positioning element at the rear portion of the control box, and wherein a bent portion of the positioning element that is fixed to the control box by the fastening element is positioned adjacent to the front portion of the control box.

2. The air-conditioning apparatus of claim 1, wherein the positioning element includes a body portion to which the pipe-side plate is fixed, and at least one arm portion connecting the body portion to the bent portion.

3. The air-conditioning apparatus of claim 1, further comprising a control box-side plate fixed to the control box and thermally connected to the pipe-side plate.

4. The air-conditioning apparatus of claim 1, wherein the control box includes a support fixed to the bent portion, the support being provided on a side wall portion at a position adjacent to the front portion, the side wall portion connecting the front portion and the rear portion to each other.

5. The air-conditioning apparatus of claim 4, wherein the bent portion and the support are fixed to each other so that the pipe-side plate is electrically grounded through the control box.

6. The air-conditioning apparatus of claim 1, wherein the pipe-side plate includes a projecting portion projecting toward the rear surface of the housing and fixed to the positioning element.

7. The air-conditioning apparatus of claim 1, wherein the refrigerant pipe includes an aluminum pipe and a copper pipe, and wherein the aluminum pipe and the copper pipe are arranged so that the aluminum pipe is above the copper pipe in a direction of gravity.

8. The air-conditioning apparatus of claim 1, wherein a portion of the refrigerant pipe that is in contact with the pipe-side plate is an aluminum pipe.

* * * * *